United States Patent [19]

Bendig

[11] Patent Number: 4,614,673

[45] Date of Patent: Sep. 30, 1986

[54] METHOD FOR FORMING A CERAMIC COATING

[75] Inventor: Anna L. Bendig, Seattle, Wash.

[73] Assignee: The Boeing Company, Seattle, Wash.

[21] Appl. No.: 747,525

[22] Filed: Jun. 21, 1985

[51] Int. Cl.[4] ..... B05D 3/02

[52] U.S. Cl. ..... 427/376.2; 427/376.4; 427/397.7; 427/427

[58] Field of Search ..... 427/376.2, 376.4, 126.4, 427/397.7, 426, 427; 428/446, 450, 472, 702

[56] References Cited

U.S. PATENT DOCUMENTS

| | | | |
|---|---|---|---|
| 2,787,965 | 4/1957 | Luvisi | 427/397.7 |
| 2,787,966 | 4/1957 | Lyons | 427/397.7 |
| 2,787,967 | 4/1957 | Nohejl | 427/397.7 |
| 2,787,968 | 4/1957 | Luvisi | 427/397.7 |
| 4,244,986 | 1/1981 | Paruso et al. | 427/126.4 |
| 4,277,525 | 7/1981 | Nakayama et al. | 427/397.7 |
| 4,420,517 | 12/1983 | Ali | 427/397.7 |
| 4,476,156 | 10/1984 | Brinker et al. | 427/376.2 |

FOREIGN PATENT DOCUMENTS

| | | | |
|---|---|---|---|
| 58-29831 | 2/1983 | Japan | 427/397.7 |

OTHER PUBLICATIONS

Nelson et al., "The Coating of Metals with Ceramic Oxides Via Colloidal Intermediates", Thin Solid Films, vol. 81, pp. 329–337, 1981.

Yoldas, "Alumina Sol Preparation from Alkoxides" Ceramic Bulletin, vol. 54, No. 3, pp. 289–290, 1975.

*Primary Examiner*—Sadie L. Childs

*Attorney, Agent, or Firm*—John C. Hammar

[57] ABSTRACT

A gelled film can be deposited directly on a sensitive substrate to obtain a protective ceramic coating on the substrate. An alumina sol, for example, can be sprayed through a flowing stream of ammonia to create a uniformly thick film, which adheres to metals, plastics, or, in some cases, water soluble materials. This film can then be cured, usually at low firing temperatures, to complete the coating.

13 Claims, No Drawings

METHOD FOR FORMING A CERAMIC COATING

TECHNICAL FIELD

The present invention relates to a method for forming a protective ceramic coating on sensitive substrates which ordinarily cannot be coated with conventional sol-gel glass ceramic precursors.

BACKGROUND ART

It is conventional to apply sol-gel glasses onto ceramic substrates to form a liquid film of the sol which wets the surface of the ceramic. To cure the film to a ceramic coating, the film may then be exposed to an ammonia environment, to heat, or to both to gel the sol, and the gelled film may be fired at temperatures usually above 600° F. to complete the coating. The ceramic substrates are generally insensitive and impervious to these firing temperatures. While this process is fine for ceramic materials, it cannot be used on sensitive materials where the sol and substrate are incompatible or where the substrate cannot tolerate high temperature firing. Certain metals, metal matrix composites, or metallized films will not be wetted by the sol, which will bead up rather than form a uniform liquid film. The method of the present invention allows protective ceramic coatings to be formed on these sensitive substrates, thereby extending their usefulness.

SUMMARY OF THE INVENTION

For sensitive substrates, the problems of conventional technologies for forming protective ceramic coatings from sols are overcome by spraying the sol through a flowing gas stream, such as ammonia, to begin the gelling process by altering the pH of the sol prior to contact of the sol with the surface of the substrate, allowing a gelled film to form directly on the substrate even if the substrate cannot ordinarily tolerate the liquid sol. The method of the present invention leads to the nondegradative formation of a substantially uniform, gelled film on the surface of such sensitive substrates as plastics, metals, metal matrix composites, and halides, and its conversion to a protective coating at low temperatures. The coating is easily completed by drying and curing the film at temperatures compatible with the substrate. Often the firing temperatures can be in the range of 200°-600° F. This low temperature curing allows some heat sensitive materials to be coated, thereby expanding the potential materials available for use in aerospace applications.

BEST MODE CONTEMPLATED FOR THE INVENTION

A protective ceramic coating, such as an alumina glass, can be formed by spraying an aqueous or alcohol sol-gel glass (sol) through a flowing, anhydrous ammonia gas stream at ambient temperature to alter the pH of the sol to begin the gelling process prior to contact of the sol with the surface of a sensitive substrate. In this way, a gelled film of controllable and uniform thickness is deposited directly on the substrate. The substrate typically is a metal, metallized film a metal matrix composite, a plastic, or a halide which would not be wet by the conventional sol, or which would dissolve when contacted with a conventional aqueous sol. Such substrates are defined as "sensitive substrates" for purposes of this description.

A preferred alumina sol is prepared from aluminum alkoxides ($Al(OR)_3$) according to the method of Yoldas, *Ceramic Bulletin,* vol. 54, No. 3, p. 289-290 (1975), so that the sol and the resulting coating are clear. Aluminum isopropoxide or aluminum secondary butoxide may be used. The alkoxides are added under vigorous stirring to hot water (usually doubly-distilled, deionized water at about 75° C. (160° F.)) at a molar ratio of water/alkoxide of about 100. A monohydroxide forms, due to hydrolysis of the alkoxide, and this monohydroxide can be peptized upon addition of acid. The slurry of alkoxide and water is stirred for about 15-20 min prior to adding the acid.

At least about 0.03 moles of acid/mole of aluminum alkoxide (hydroxide) must be added for peptization to occur at a temperature of between about 75°-90° C. and for a clear sol to form. The amount of acid added to the slurry should be limited, however, so that the ratio does not exceed about 0.10 for inorganic acids or about 0.25 for organic acids. Suitable acids are nitric, hydrochloric, perchloric, acetic, and trichloroacetic acids. Cloudy sols may be formed with chloroacetic or formic acids. During peptization the slurry should be kept at a temperature of at least about 80° C. (170° F.).

When alumina sols of this type are sprayed through the ammonia stream, rapid gelling occurs so that a substantially uniform coat is applied without degradation of the substate. The thickness of the coating can be controlled by the degree of spraying.

A preferred silica sol is prepared from hydrolyzed or unhydrolyzed tetraethylorthosilicate, and is commercially available under the trademark SILBOND from the Stauffer Chemical Co. Other sols may also be used with alkoxide or acetate precursors, provided that the sols gel upon a pH change. For example, a barium magnesium aluminosilicate sol-gel glass can be prepared from mixed acetates, and can be sprayed through flowing anhydrous ammonia to deposit a gelled film on the substrate. Such a sol is preferred for application to many composite materials since the sol is compatible with such substrates, and its gelled ceramic glass exhibits low expansion characteristics.

While anhydrous ammonia is most commonly used to create the desired pH change in the sol prior to contact with the substrate, other gases might be used to alter the pH of the sol into the gelling range. Those skilled in the art will recognize such gases or mixtures based upon this description and the known characteristics of the sols with which they are working.

For purposes of this description, the terms "sol" and "sol-gel glass" are used interchangeably.

Once applied to the surface of the sensitive substrate by spraying through the ammonia stream, the gelled film can be dried and cured to the final heating the substrate in an oven to form an amorphous gel coating. The curing temperature is dictated by the thermal stability of the substrate and by the desired molecular order for or crystallinity of the coating. Often, curing temperatures as low as between 200°-600° F. can be used, and lower temperature processing is preferred. Alternatively to low temperature curing, flash heating may be used to gel the surface film without unduly heating the underlying substrate. Examples of flash heating include flame spraying, or ultraviolet, infrared, or r.f. curing techniques. Thus, coatings can be applied, not only to substrates which are sensitive to the sol, but also to substrates which cannot resist high temperature firing of conventional sol-gel coatings. The process of the present invention allows many new materials to be used in aerospace applications. For purposes of this description, "sensitive substrates" include materials, such as plastics, that, for example, are unable to withstand conventional alumina sol-gel firing temperatures. For aqueous alumina sols, curing at temperatures of at least about 525° F. avoids rehydration problems of the ceramic coating.

While preferred embodiments of the invention have been described, those skilled in the art will readily recognize alterations, variations, or modifications that might be made to the embodiments without departing from the inventive concept. Therefore, the invention, as defined by the claims, should be construed broadly to cover the embodiments and all their full range of equivalents. The claims should not be limited to these particular embodiments, unless such limitation is necessary in view of the pertinent prior art.

I claim:

1. A method for forming a protective ceramic coating on the surface of a sensitive substrate, such as on a metal, a metal matrix composite, or a plastic which is not wet by a conventional sol, the method comprising the steps of:

(a) spraying a sol, containing a ceramic precursor in a carrier through a flowing stream of a suitable gas to alter the pH of the sol, and, thereby, to deposit a gelled film directly on the surface; and (b) drying and curing the film under conditions suitable for the substrate to complete the protective ceramic coating.

2. The method of claim 1 wherein the sol is made from aluminum alkoxide ($Al(OR)_3$).

3. The method of claim 1 wherein step b occurs at a temperature below about 600° F.

4. The method of claim 1 wherein the gas includes ammonia.

5. The method of claim 1 further comprising the steps of repeating steps a and b to build up the coating in successive layers.

6. The method of claim 1 wherein the carrier includes water.

7. The method of claim 1 wherein the carrier includes an alcohol.

8. The method of claim 2 wherein the sol includes a sufficient amount of a suitable acid to hydrolyze and peptize the alkoxide.

9. A method for forming a protective alumina coating on the surface of a sensitive substrate, such as on a metal, a metal matrix composite or a plastic which is not wet by a conventional alumina sol, the method comprising the steps of:

(a) spraying an alumina sol containing alumina in isopropanol at the surface through a flowing stream of anhydrous ammonia to deposit a gelled film directly on the surface;

(b) continuing the spraying to build up a substantially uniform film of the desired thickness; and (c) drying and curing the film at a temperature between 200°–600° F. to complete the protective alumina coating.

10. A method for forming a protective, transparent, alumina coating on the surface of a sensitive substrate, such as on a metal or plastic which is not wet by a conventional alumina sol the method comprising:

(a) preparing a hydrolyzed sol by adding aluminum alkoxide to a carrier of water, isopropanol, or a mixture thereof;

(b) peptizing the hydrolyzed sol to form a clear sol by adding a sufficient amount of a suitable acid to the sol, such that the ratio of acid/hydroxide is at least about 0.03 on a molar basis;

(c) spraying the peptized sol through a flowing stream of ammonia at the surface of the substrate to deposit a gelled film on the surface; and (d) drying and curing the film at a temperature below about 600° F. to complete the protective coating.

11. The method of claim 10 wherein the sol is prepared with vigorous stirring, and the hydrolysis step occurs at a temperature of about 170° F.

12. The method of claim 11 wherein the acid is selected from the group consisting of nitric, hydrochloric, perchloric, acetic, and trichloroacetic acids and wherein the ratio of acid/hydroxide is between about 0.03–0.10 on a molar basis.

13. The method of claim 12 wherein the carrier is water.

* * * * *